US007964269B2

(12) United States Patent
Lee et al.

(10) Patent No.: US 7,964,269 B2
(45) Date of Patent: Jun. 21, 2011

(54) COLORLESS THERMAL MASS TRANSFER COMPOSITIONS AND ARTICLES

(75) Inventors: Jennifer L. Lee, Eagan, MN (US); Mark W. Leverty, Roberts, WI (US); Scott A. Boyd, White Bear Lake, MN (US); Eugene H. Carlson, Apple Valley, MN (US); Lisa Flatt Nelson, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1055 days.

(21) Appl. No.: 11/562,507

(22) Filed: Nov. 22, 2006

(65) Prior Publication Data

US 2008/0118638 A1 May 22, 2008

(51) Int. Cl.
*B41M 5/00* (2006.01)
*B44C 1/17* (2006.01)
*G03G 7/00* (2006.01)

(52) U.S. Cl. ..... 428/195.1; 428/480; 428/500; 428/913; 428/913.3; 428/914; 359/529; 359/530; 359/534; 359/536; 359/542

(58) Field of Classification Search ..... 428/32.39, 428/195.1, 480, 500, 913, 913.3, 914; 359/529, 359/530, 534–542
See application file for complete search history.

(56) References Cited

U.S. PATENT DOCUMENTS

| | | | | |
|---|---|---|---|---|
| 5,312,692 | A * | 5/1994 | Shiraishi | 428/32.87 |
| 5,508,105 | A | 4/1996 | Orensteen et al. | |
| 5,837,347 | A | 11/1998 | Marecki | |
| 5,861,211 | A | 1/1999 | Thakkar et al. | |
| 5,940,212 | A | 8/1999 | Johnson et al. | |
| 6,066,384 | A | 5/2000 | Crandall | |
| 6,190,757 | B1 | 2/2001 | Nelson et al. | |
| 6,706,341 | B1 | 3/2004 | Schnitzel et al. | |
| 6,726,982 | B2 | 4/2004 | Christian et al. | |
| 6,730,376 | B2 | 5/2004 | Stofko et al. | |
| 2003/0224128 | A1 * | 12/2003 | Ylitalo et al. | 428/32.1 |
| 2003/0224150 | A1 * | 12/2003 | Ludwig et al. | 428/195.1 |
| 2006/0292353 | A1 | 12/2006 | Lee et al. | |

FOREIGN PATENT DOCUMENTS

| | | |
|---|---|---|
| EP | 0778801 | 10/1998 |
| WO | WO 94/19769 | 9/1994 |
| WO | WO 95/12515 | 5/1995 |

OTHER PUBLICATIONS

Formulator Resources, Millennium Chemicals, introduction to light scattering and opacity, pp. 1-4.
Statement on IDS Cover Letter.

* cited by examiner

*Primary Examiner* — Mark Ruthkosky
*Assistant Examiner* — David J Joy
(74) *Attorney, Agent, or Firm* — Sandra K. Novak

(57) ABSTRACT

Retroreflective sheeting articles comprising a colorless thermal mass transferred image, methods of thermal mass transfer printing substrate such as polymeric films with a colorless thermal mass transferable composition, and thermal mass transfer ribbon articles comprising a colorless thermal mass transferable composition are described. The thermal mass transfer composition comprises a homogeneous unreactive thermoplastic composition comprising at least one acrylic resin and less than 3 wt-% of components that are opaque at ambient temperature.

15 Claims, 1 Drawing Sheet

COLORLESS THERMAL MASS TRANSFER COMPOSITIONS AND ARTICLES

BACKGROUND

Thermal printing is a term broadly used to describe several different families of technology for making an image on a substrate. Those technologies include hot stamping, direct thermal printing, dye diffusion printing and thermal mass transfer printing.

Hot stamping is a mechanical printing system in which a pattern is stamped or embossed through a ribbon onto a substrate, such as disclosed in WO95/12515. The pattern is imprinted onto the substrate by the application of heat and pressure to the pattern. A colored material on the ribbon, such as a dye or ink, is thereby transferred to the substrate where the pattern has been applied. The substrate can be preheated prior to imprinting the pattern on the substrate. Since the stamp pattern is fixed, hot stamping cannot easily be used to apply variable indicia or images on the substrate. Consequently, hot stamping is typically not useful for printing variable information, such as printing sheets used to make license plates.

Direct thermal printing was commonly used in older style facsimile machines. Those systems required a special substrate that includes a colorant so that localized heat can change the color in the specified location. In operation, the substrate is conveyed past an arrangement of tiny individual heating elements, or pixels, that selectively heat (or not heat) the substrate. Wherever the pixels heat the substrate, the substrate changes color. By coordinating the heating action of the pixels, images such as letters and numbers can form on the substrate. However, the substrate can change color unintentionally such as when exposed to light, heat or mechanical forces.

Dye diffusion thermal transfer involves the transport of dye by the physical process of diffusion from a dye donor layer into a dye receiving substrate. Typically, the surface of the film to be printed further comprises a dye receptive layer in order to promote such diffusion. Similar to direct thermal printing, the ribbon containing the dye and the substrate is conveyed past an arrangement of heating elements (pixels) that selectively heat the ribbon. Wherever the pixels heat the ribbon, solid dye liquefies and transfers to the substrate via diffusion. Some known dyes chemically interact with the substrate after being transferred by dye diffusion. Color formation in the substrate may depend on a chemical reaction. Consequently, the color density may not fully develop if the thermal energy (the temperature attained or the time elapsed) is too low. Thus, color development using dye diffusion is often augmented by a post-printing step such as thermal fusing.

Thermal mass transfer printing, also known as thermal transfer printing, non-impact printing, thermal graphic printing and thermography, has become popular and commercially successful for forming characters on a substrate. Like hot stamping, heat and pressure are used to transfer an image from a ribbon onto a substrate. Like direct thermal printing and dye diffusion printing, pixel heaters selectively heat the ribbon to transfer the colorant to the substrate. However, the colorant on the ribbon used for thermal mass transfer printing comprises a polymeric binder having a wax base, resin base or mixture thereof typically containing pigments and/or dyes. During printing, the ribbon is positioned between the print head and the exposed surface of the polymer film. The print head contacts the thermal mass transfer ribbon and the pixel heater heats the ribbon such that it transfers the colorant from the ribbon to the film as the film passes through the thermal mass transfer printer.

Thermal mass transfer has been described for imaging retroreflective sheeting. See for example WO 94/19769 and U.S. Pat. No. 5,508,105.

U.S. Pat. No. 6,730,376 describes a photocurable thermally transferable composition containing a multifunctional monomer that is substantially non-liquid at room temperature and a thermoplastic binder. The composition is suitable to use in thermal transfer ribbons. After thermal transfer, the compositions are photocured to provide a durable, weatherable image, on a graphic article.

U.S. Pat. No. 6,726,982 describes thermal transfer articles comprising a carrier, optional release layer, a color layer releasably adhered thereto, and optionally an adherence layer on the bottom side of the color layer. The transfer articles are radiation crosslinked after transfer such that a durable image is formed.

U.S. Pat. No. 6,190,757 describes coatable thermal mass transfer precursor compositions comprising a polyalkylene binder precursor, an acrylic binder precursor, an effective amount of pigment and a diluent (preferably water). As described at column 4, lines 54-56, the polyalkylene latex and acrylic latex binder precursors are immiscible. The acrylic latex binder forms islands in the film formed by the polyalkylene binder.

Colorless thermal mass transfer ribbons have been employed to print on top of both thermal mass transferred imaged and unimaged retroreflective sheeting. Such retroreflective sheeting printed with commercially available colorless thermal mass transfer ribbons has been found to exhibit reduced gloss and lower retroreflected brightness.

SUMMARY OF THE INVENTION

Although various thermal mass transfer compositions suitable for imaging retroreflective sheeting have been described, industry would find advantage in alternative compositions. For example, industry would find advantage in durable colorless compositions that do not necessitate radiation curing. Industry would also find advantage in imaged articles such as retroreflective sheeting having improved gloss and/or improved retroreflected brightness.

The invention relates to a colorless thermal mass transferable composition that is a homogenous unreactive thermoplastic composition that comprises at least one acrylic resin and contains less than 3 wt-% of components that are opaque at ambient temperature. In some aspects, the colorless thermal mass transfer composition comprises one or more (i.e. unreactive) acrylic resins in an amount ranging from about 50 wt-% to about 95 wt-% of the polymeric components of the composition and optionally up to about 50 wt-% of one or more additional (e.g. non-acrylic) modifying thermoplastic resin(s). The modifying thermoplastic resin is preferably selected from a polyvinyl resin, a polyester, a polyurethane, and mixtures thereof. In some aspects, the acrylic resin has an average molecular weight of at least 80,000 g/mole.

In one embodiment, (e.g. retroreflective sheeting) articles are described that comprise a polymeric film having at least one viewing surface and the colorless thermal mass transfer composition disposed in the optical path of the viewing surface. In some aspects, the percent of maximum diffuse luminous transmittance to total luminous transmittance (maximum diffuse luminous transmittance divided by total luminous transmission multiplied by 100) of the composition is preferably less than 50%.

In another embodiment, a method is described comprising providing a polymeric film substrate comprising at least one viewing surface, and thermal mass transfer printing the viewing surface with the colorless homogeneous unreactive thermoplastic composition.

In yet another embodiment, a thermal mass transfer ribbon article is described that comprises a carrier and a colorless homogeneous unreactive thermoplastic composition comprising at least one acrylic resin and less than 3 wt-% of components that are opaque at ambient temperature.

In each of these embodiments, the colorless thermal mass transfer composition may be used in combination with a colored thermal mass transfer composition. The colored and colorless thermal mass transfer composition may be printed sequentially. In one aspect, a durable colorless thermal mass transferred composition is provided as a surface layer over a colored thermal mass transferred image. In another aspect, a colorless thermal mass transferred composition can be employed as a primer by being provided on the substrate surface beneath the colored thermal mass transferred image. In this aspect, the colorless thermal mass transferred composition typically has a higher concentration of a modifying polymer.

Alternatively, the colored and colorless thermal mass transfer composition may be printed concurrently by providing a thermal mass transfer ribbon having a colorless composition between the carrier and colored composition and/or above the colored composition. The colored thermal mass transfer composition preferably also comprises acrylic resin and less then 3 wt-% of components that are opaque at ambient temperature.

BRIEF DESCRIPTION OF THE DRAWINGS

The invention will be further explained with reference to the drawing, wherein.

DETAILED DESCRIPTION

Presently described are (e.g. retroreflective sheeting) articles comprising a colorless thermal mass transferred image, methods of thermal mass transfer printing substrate such as polymeric films with a colorless thermal mass transferable composition, and thermal mass transfer ribbon articles comprising a colorless thermal mass transferable composition.

Colorless refers to lacking color. Accordingly, the colorless thermal mass transfer compositions described herein are substantially free of pigment or dye that absorbs light. Colorless compositions provided at a thickness of about 20 microns typically have an absorbance of less than 0.2 for visible light, i.e. wavelengths ranging from about 400 nm to 700 nm.

Transparent refers to the capability of transmitting light. Both colored and colorless composition can be transparent.

The article or substrate (e.g. film, sheet) has two major surfaces. The first surface, denoted herein as the "viewing surface", comprises the colorless thermal mass transferred composition. The opposing surface of the article may also comprise the colorless thermal mass transferred composition optionally in combination with a colored printed image. Alternatively, and most common however, the opposing surface is a non-viewing surface that typically comprises a pressure sensitive adhesive protected by a release liner. The release liner is subsequently removed and the imaged substrate (e.g. sheeting, film) is adhered to a target surface such as a sign backing, billboard, automobile, truck, airplane, building, awning, window, floor, etc.

The substrates as well as the imaged article (e.g. sheets, films, polymeric materials) for use in the invention may be clear, translucent, or opaque. Further, the substrate and imaged article may be colorless, comprise a solid color or comprise a pattern of colors. Additionally, the substrate and imaged articles (e.g. films) may be transmissive, reflective, or retroreflective.

Commercially available films include a multitude of films typically used for signage and commercial graphic uses such as available from 3M under the trade designations "Panaflex", "Nomad", "Scotchcal", "Scotchlite", "Controltac", and "Controltac Plus". Retroreflective sheeting is commercially available from 3M Company, St. Paul, Minn. under the trade designations "3M" and "Diamond Grade".

The articles of the invention will be described with reference to retroreflective sheeting articles. Such articles are commonly employed in traffic signage and license plates as well as other traffic warning items such as roll-up signs; cone, post and barrel wrap sheeting; barricade sheeting, and pavement marking tapes.

Figure 1:
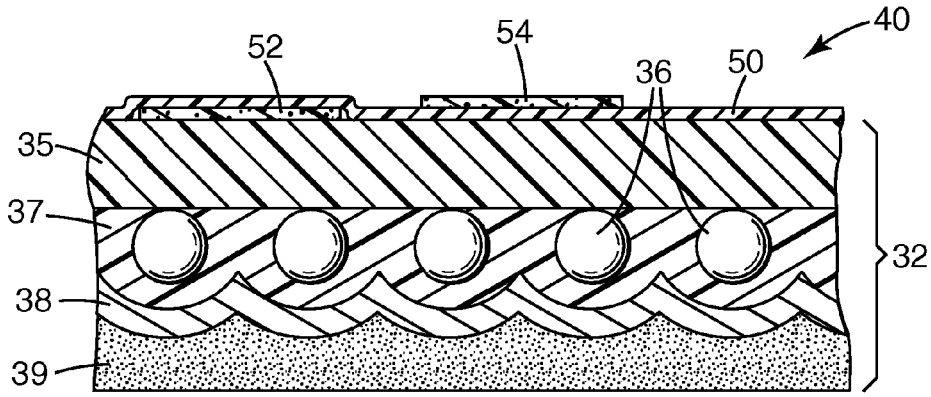
FIG. 1 is a schematic cross-sectional view of an enclosed-lens retroreflective article having a thermal mass transferred image.

FIG. 1 is an illustrative embodiment. Article 40 comprises an optically complete retroreflective sheeting 32 and a colorless thermal mass transferred protective composition 50 provided on thermal mass transfer receiving layer 35. Alternatively, multiple layers of the colorless thermal mass transferred composition can be applied to an optically incomplete sheeting (e.g. wherein layer 35 is absent). The colorless thermal mass transferred composition 50 is typically the surface of the article exposed to the (e.g. outdoor) environment. Retroreflective sheeting substrate 32 may comprise a monolayer of glass or ceramic microsphere retroreflective elements 36 embedded in binder layer 37 with underlying reflecting layer 38. Such retroreflective base sheets are well known and disclosed in, for example, U.S. Pat. No. 4,664,966 (Bailey et al.) and U.S. Pat. No. 4,983,436 (Bailey et al.). Illustrative examples of materials used in binder layer 37 include polyvinyl butyral and polyurethane alkyd. Retroreflective article 40 also comprises preferably comprises optional adhesive layer 39 that may have an optional liner thereon (not illustrated).

Figure 2:
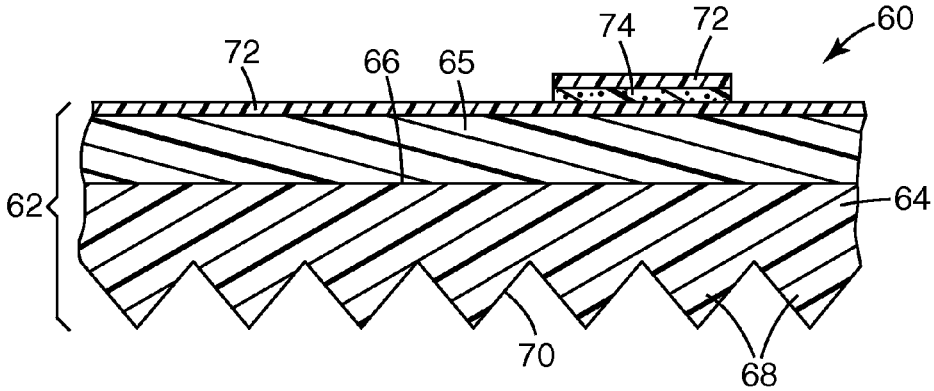
FIG. 2 is a schematic cross-sectional view of a cube corner retroreflective article having a thermal mass transferred image.

Another embodiment is illustrated in FIG. 2 wherein article 60 comprises retroreflective substrate 62 and the colorless thermal mass transferred composition 72 on thermal mass transfer receiving layer 65. Substrate 62 comprises cube-corner type retroreflective sheeting 64 with flat front surface 66 and a plurality of cube-corner elements 68 protruding from rear surface 70 thereof. Illustrative cube-corner type retroreflective sheetings are disclosed in U.S. Pat. No. 3,712,706 (Stamm), U.S. Pat. No. 4,243,618 (Van Arnam), U.S. Pat. No. 4,349,598 (White), U.S. Pat. No. 4,588,258 (Hoopman), U.S. Pat. No. 4,775,219 (Appledorn et al.), and U.S. Pat. No. 4,895,428 (Nelson et al.) and U.S. Publication No. 2006/0007542; all of which are incorporated by reference herein. Typically, cube-corner elements 68 will be encapsulated using a sealing film (not shown), such as is disclosed in U.S. Pat. No. 4,025,159 (McGrath).

Typically, the colorless thermal mass transferred composition is employed in combination with a colored thermal mass transferred composition (e.g. 52, 54 and 74), the colored composition forming a visible image such as the alphanumeric characters of a license plate or (e.g. traffic) sign. The colored thermal mass transferred image is typically buried beneath the colorless thermal mass transferred composition (e.g. such as 52 of FIG. 1). The retroreflective article may have a combination of at least one exposed colored thermal mass transferred image 54 and at least one unexposed colored thermal mass transferred image 52, such as shown in FIG. 1. Further, a cover film or topcoat may optionally be applied over 50 or 72. However, the colorless thermal mass transferred protective layer typically provides sufficient protective properties such that a cover film or topcoat is not required.

Regardless of whether the retroreflective sheeting comprises microsphere or cube corner elements, the colorless thermal transferred composition is provided in the optical path of the retroreflective base sheet, meaning that the colorless composition lies within the path taken by incident light that is retroreflected by the resultant article. Accordingly, the colorless thermal transferred composition is disposed between the retroreflective elements (e.g. 68 or 36 in combination with 38) and the viewing surface of the sheeting.

The substrate or receiving layer of the thermal mass transfer printed composition (e.g. 35, 65 of FIG. 1-2) may comprise various polymeric materials including for example acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. The reception layers of the colored or colorless thermal mass transfer printed composition may comprise an acid- or acid/acrylate modified ethylene vinyl acetate resin, as disclosed in U.S. Pat. No. 5,721,086 (Emslander et al.). The reception layers of the colored or colorless thermal mass transfer printed composition may comprise a water-borne acrylic polymer topcoat. The dried and optionally cured topcoat may have an elastic modulus when tested with nanoindentation ranging from 0.2 GPa to 2.0 Gpa, as described in Published U.S. Patent Application No. 2004/0018344; incorporated herein by reference. Further the reception layer may be surface treated (e.g. corona) and/or comprise a primer to improve adhesion of the colorless or colored thermal mass transferred composition.

The thickness of the colorless and colored thermally transferred layer will vary. Thicker transfer layers may require longer exposure times of the ribbon and underlying retroreflective sheeting to the heat source and/or higher heat source temperatures. The thermal mass transferred image typically has a thickness of at least 1 and no greater than about 10 microns. The thickness may be 2, 3, 4, 5, 6, 7, 8, or 9 micrometers. However, the thickness may range as high 25 micrometers (1 mil). When the desired thickness exceeds the thickness of the colored or colorless layer of a single ribbon, the retroreflective sheeting can be thermal mass transfer printed two or more times to build up the thickness.

The (e.g. retroreflective) articles described herein are "durable for outdoor usage" which refers to the ability of the article to withstand temperature extremes, exposure to moisture ranging from dew to rainstorms, and colorfast stability under sunlight's ultraviolet radiation. The threshold of durability is dependent upon the conditions to which the article is likely to be exposed and thus can vary. At minimum, however, the articles of the present invention do not delaminate or deteriorate when submersed in ambient temperature (25° C.) water for 24 hours, nor when exposed to temperatures (wet or dry) ranging from about −40° C. to about 140° F. (60° C.).

In the case of signage for traffic control, the articles are preferably sufficiently durable such that the articles are able to withstand at least one year and more preferably at least three years of weathering. This can be determined with ASTM D4956-05 Standard Specification of Retroreflective Sheeting for Traffic Control that describes the application-dependent minimum performance requirements, both initially and following accelerated outdoor weathering, of several types of retroreflective sheeting. Initially, the reflective substrate meets or exceeds the minimum coefficient of retroreflection. For Type I white sheetings ("engineering grade"), the minimum coefficient of retroreflection is 70 cd/fc/ft$^2$ at an observation angle of 0.2° and an entrance angle of −4°, whereas for Type III white sheetings ("high intensity") the minimum coefficient of retroreflection is 250 cd/fc/ft$^2$ at an observation angle of 0.2° and an entrance angle of −4°. Further, for Type IX white sheetings, the minimum coefficient of retroreflection is 380 cd/fc/ft$^2$ at an observation angle of 0.2° and an entrance angle of −4°. In addition, minimum specifications for shrinkage, flexibility, adhesion, impact resistance and gloss are preferably met. After accelerated outdoor weathering for 12, 24, or 36 months, depending on the sheeting type and application, the retroreflective sheeting preferably shows no appreciable cracking, scaling, pitting, blistering, edge lifting or curling, or more than 0.8 millimeters shrinkage or expansion following the specified testing period. In addition, the weathered retroreflective articles preferably exhibit at least the minimum coefficient of retroreflection and colorfastness. For example, Type I "engineering grade" retroreflective sheeting intended for permanent signing applications retains at least 50% of the initial minimum coefficient of retroreflection after 24 months of outdoor weathering and Type III and IX "high intensity" type retroreflective sheeting intended for permanent signing applications retains at least 80% of the initial minimum coefficient of retroreflection following 36 months of outdoor weathering in order to meet the specification. The target values for the initial and weathered coefficient of retroreflection values for colored sheeting is described in ASTM-D4956-05.

Presently described are certain colorless thermal mass transfer compositions. The thermal mass transfer compositions described herein are unreactive. The thermal mass transfer compositions are substantially free of ingredients that are crosslinkable (e.g. upon exposure to actinic radiation).

The formation of a visibly homogenous blend (the blend appears homogeneous and uniform to the eye) is important, as visibly non-homogenous polymer blends will not form a continuously transparent film as is necessary for the representation of retroreflective colors. High transparency is attained by maintaining similarity between the refractive indexes of all components of the composition of the invention. In addition the thermal mass transfer composition contains only small concentrations or more preferably is free of components that are opaque at ambient temperature such as inorganic fillers and waxes. The concentration of opaque components in the solid colorless thermal transfer composition is typically less than 3 wt-% and preferably less than 1 wt-%.

The terms "opacity" and "opaque" are used in various contexts to describe something that is not transparent. Two factors give rise to the opacifying properties of a film, i.e. the scattering and absorption of light. Colored pigments preferentially absorb light in a specific portion of the spectrum. The observed color is a function of the portion of the spectrum in which the light is reflected. On the other hand, light bends and is scattered because of its different speeds in different media as a result of differences in refractive indices. It is appreciated that inorganic fillers and crystalline components such as certain polymers and waxes contribute to opacity primarily in view of their light scattering properties.

One way of detecting the presence of light scattering components is diffuse luminous transmittance, as determined according to the test method described in pending U.S. Ser. No. 11/171,947, Jun. 30, 2005. The retroreflective sheeting is preferably imaged with a colorless thermal mass transfer composition that has a percent of maximum diffuse luminous transmittance to total luminous transmittance of less than 50%. The percent of maximum diffuse luminous transmittance to total luminous transmittance is more preferably less than 40%, 30%, or 20%.

When the colorless thermal mass transfer composition is employed in combination with a colored thermal mass transfer composition, it is preferred that the colored composition also has the same properties as described for the colorless thermal mass transfer composition (e.g. a low concentration of opaque components, etc. as described herein).

The colorless and optional colored thermal transfer compositions comprise one or more unreactive thermoplastic acrylic polymers. In at least some embodiments, the thermoplastic composition comprises at least 50 wt-% of one or more unreactive thermoplastic acrylic polymers. The thermal transfer composition typically comprises at least 55 wt-% to 60 wt-% and no more than about 80 wt-% unreactive thermoplastic acrylic polymer.

In general, acrylic resins are prepared from various (meth) acrylate monomers such as methyl methacrylate (MMA), ethyl acrylate (EA), butyl acrylate (BA), butyl methacrylate (BMA), n-butyl methacrylate (n-BMA) isobutylmethacrylate (IBMA), ethylmethacrylate (EMA), etc. alone or in combination with each other. Exemplary acrylic resins include those commercially available from Rohm and Haas, Co., Philadelphia, Pa. under the trade designation "Paraloid", from Lucite International, Inc., Cordova, Tenn. under the trade designation "Elvacite" and from Dianal America, Inc., Pasadena, Tex. under the trade designation "Dianal" resins. Other suitable polyacrylic materials include those from S.C. Johnson, Racine, Wis. under the trade designation "Joncryl" acrylics.

The unreactive thermoplastic acrylic polymer may optionally be combined with a second or additional modifying unreactive thermoplastic polymer(s). The modifying polymer is compatible (i.e. miscible) with the unreactive thermoplastic polymer resulting in a homogenous mixture. The modifying polymer may be employed to adjust the Tg of the acrylic polymer. The modifying polymer may also reduce the viscosity of the mixture including the acrylic polymer. The amount of modifying polymer may range from about 5 wt-% to about 50 wt-%.

Suitable thermoplastic modifying polymers include (e.g. lower molecular weight or butyl acrylate containing) acrylic resin(s), polyvinyl resin(s), polyester(s), polyacrylate(s), polyurethane(s) and mixtures thereof. Polyvinyl resins include copolymers and terpolymers, such as available from Union Carbide Corp., a subsidiary of The Dow Chemical Company ("Dow"), Midland Mich. under the trade designations "UCAR" and "VAGH" ("VAGH" is a "UCAR" resin). Polyester resins include copolyester resins commercially available from Bostik Inc., Middleton, Mass. under the trade designation "Vitel" copolyester resins available from Eastman Chemical, Kingsport, Tenn. under the trade designation "Eastar" as well as other polyester resins available from Bayer, Pittsburg, Pa. under the trade designations "Multron" and "Desmophen" Spectrum Alkyd & Resins Ltd., Mumbia, Maharshtra, India under the trade designation "Spectraalkyd" and Akzo Nobel, Chicago, Ill. under the trade designation "Setalin" alkyd. Preferred polymer species exhibit the diffuse luminous transmittance properties previously described. When a modifying polymer(s) is employed, the blended polymers are sufficiently compatible such that the blend is optically transparent.

In some embodiments, the weight average molecular weight of the unreactive thermoplastic polymer (i.e. acrylic polymer and optional modifying polymer) is chosen to maximize the durability in combination with providing a composition that can provide a sufficiently low enough viscosity when dispersed in (e.g. organic) solvent to be coated by conventional techniques onto a carrier to be formed into a thermal mass transfer ribbon.

The weight average molecular weight (Mw) of the unreactive thermoplastic (e.g. acrylic or acrylic blend) polymer as measured by Gel Permeation Chromotography (GPC) is typically at least 15,000 g/mole, yet typically less than 200,000 g/mole. Preferably the base polymer has an Mw of less than 165,000 g/mole, more preferably less than about 150,000 g/mole. In at least some embodiments the Mw of the acrylic resin is at least 80,000 g/mole. When a durable colorless thermal mass transferred composition is provided over a colored thermal mass transferred composition, the polymer material of the colored thermal mass transferred composition may have a lower molecular weight in view of the protective properties contributed by the colorless thermal mass transferred composition.

In the case wherein the unreactive thermoplastic polymer comprises a blend of two or more polymeric species, the Mw of the blend, for purposes of the present invention, refers to the Mw calculated in accordance with the following equation:

Mw (blend)=$\Sigma\ w_x\ M_x$; wherein $M_x$ is the weight average molecular weight of each polymeric species and $w_x$ is the weight fraction of such polymeric species with respect to the blend.

Accordingly, in the case of a bimodal blend, the Mw of the blend is typically a median value between the peaks.

In addition, the unreactive thermoplastic polymer of the thermal mass transfer composition has a glass transition temperature (Tg), as measured according to Differential Scanning Colorimetry (DSC) from about 30° C. to about 110° C. and preferably from about 50° C. to about 100° C. At a Tg of less than about 30° C., dirt can accumulate on the imaged surface. At a Tg of greater than about 110° C., the thermal mass transferred image is typically brittle such that the primer coating is susceptible to cracking upon being flexed or creased. However, relatively high Tg polymers can usefully be employed to at least some extent by combination with a compatible modifying polymer having a lower Tg.

In the case of unreactive thermoplastic polymer compositions comprising two or more polymers wherein each has a distinct peak, the Tg of the blend, for purposes of the present invention, refers to the Tg calculated in accordance with the following equation:

1/Tg (blend)=$\Sigma\ w_x/Tg_x$; wherein $Tg_x$ is the Tg of each polymeric species and $w_x$ is the weight fraction of such polymeric species with respect to the blend. Tg values in the above equation are measured in degrees Kelvin.

The molecular weight of each modifying polymer employed may be less than 50,000 g/mole, less than 40,000 g/mole, or less than 30,000 g/mole. The modifying polymer may have even a lower molecular provided that the modifying polymer is a solid at ambient temperature.

The chemical composition, molecular weight, and Tg of various unreactive thermoplastic acrylic resins that may be used in the preparation of the colorless and colored thermal mass transferable compositions are set forth in Table 1 as follows:

TABLE 1

| Trade Name | Chemical Composition | Molecular Weight (Mw) G/mole | Tg (° C.) |
|---|---|---|---|
| "Paraloid A-11" | PMMA | 125,000 | 100 |
| "Paraloid A-14" | PMMA | 90,000 | 95 |
| "Paraloid A-21" | PMMA | 120,000 | 105 |
| "Paraloid B-44" | MMA/EA | 140,000 | 60 |
| "Paraloid B-60" | MMA/BMA | 50,000 | 75 |
| "Elvacite 2010" | PMMA | 84,000 | 98 |
| "Elvacite 2021" | MMA/EA 95-5 | 119,000 | 100 |
| "Elvacite 2044" | n-BMA | 140,000 | 15 |
| "Elvacite 2046" | n-BMA/IBMA | 165,000 | 35 |
| "Elvacite 4028" | PMMA | 108,000 | 85 |
| "Dianal BR-80" | PMMA | 95,000 | 113 |

Representative colorless and colored thermal mass transferable compositions are depicted in Table 2 as follows:

TABLE 2

| Acrylic Resin | Acrylic Resin Concentration | VAGH Concentration | Pigment Green 7 |
|---|---|---|---|
| "Paraloid A-11" | 40 wt-% | 30 wt-% | 30 wt-% |
| "Paraloid A-11"* | 64 wt-% | 28 wt-% | — |
| "Paraloid A-14" | 40 wt-% | 30 wt-% | 30 wt-% |
| "Paraloid A-14"* | 64 wt-% | 28 wt-% | — |
| "Paraloid A-21" | 40 wt-% | 30 wt-% | 30 wt-% |
| "Paraloid A-21"* | 64 wt-% | 28 wt-% | — |
| "Paraloid B-44" | 55 wt-% | 15 wt-% | 30 wt-% |
| "Paraloid B-60" | 50 wt-% | 20 wt-% | 30 wt-% |
| "Elvacite 2010" | 40 wt-% | 30 wt-% | 30 wt-% |
| "Elvacite 2010"* | 64 wt-% | 28 wt-% | — |
| "Elvacite 2021" | 40 wt-% | 30 wt-% | 30 wt-% |
| "Elvacite 2021"* | 64 wt-% | 28 wt-% | — |
| "Elvacite 2044" | 70 wt-% | — | 30 wt-% |
| "Elvacite 2046" | 70 wt-% | — | 30 wt-% |
| "Elvacite 4028" | 50 wt-% | 15 wt-% | 30 wt-% |
| "Dianal BR-80"* | 64 wt-% | 28 wt-% | — |

*Contains 8 wt-% stabilizers.

The colorless and optional colored thermal transfer compositions of the invention have a softening or melting temperature low enough to permit quick, complete transfer under high-speed production conditions, yet high enough to avoid softening or blocking during routine storage, such as storage as a roll good. In some embodiments the thermally transferable composition has a softening or melting temperature of at least about 50° C., 60° C., or 70° C. Further the softening or melting temperature is typically less than 140° C., 130° C., or 120° C.

The optional colored thermal mass transferred compositions described herein comprise one or more coloring agents such as organic or inorganic pigments or dyes. If desired, the color agents may be fluorescent.

Typically to be useful in a retroreflective application, the colorant is transparent so the color is similar when viewed under either ordinary diffuse light conditions (e.g., under daylight) or under retroreflective conditions (e.g., at night time when illuminated by vehicle headlights). This typically requires pigments with a relatively narrow absorption band to yield a saturated color and pigment particles with an average refractive index of about 1.5 and an average diameter less than 1 micron in order to minimize light scattering. It is also preferred that the particle have an index of refraction that is close to that of the surrounding matrix so as to make any discontinuity less visible. It is especially preferred when organic pigments are used that such pigments be of small particle size so as to minimize light scattering as light passes through the color layer. Dyes also reduce light scattering but generally exhibit a greater tendency to migrate in these materials and therefore are more suitable for applications with shorter lifetimes.

Illustrative examples of suitable organic pigments include phthalocyanines, anthraquinones, perylenes, carbazoles, monoazo- and diazobenzimidazolone, isoindolinones, monoazonaphthol, diarylidepyrazolone, rhodamine, indigoid, quinacridone, disazopyranthrone, dinitraniline, pyrazolone, dianisidine, pyranthrone, tetrachloroisoindolinone, dioxazine, monoazoacrylide, anthrapyrimidine. It will be recognized by those skilled in the art that organic pigments may be differently shaded, or even differently colored, depending on the functional groups attached to the main molecule. However, many of the listed organic pigments have exhibited good weatherability in simulated outdoor use in that they retain much of their initial brightness and color, as exemplified herein below.

Commercial examples of useful organic pigments include those known under the trade designations PB 1, PB 15, PB 15:1, PB 15:2, PB 15:3, PB 15:4, PB 15:6, PB 16, PB 24, and PB 60 (blue pigments); PB 5, PB 23, and PB 25 (brown pigments); PY 3, PY 14, PY 16, PY 17, PY 24, PY 65, PY 73, PY 74, PY 83, PY 95, PY 97, PY 108, PY 109, PY 110, PY 113, PY 128, PY 129, PY 138, PY 139, PY 150, PY 154, PY 156, and PY 175 (yellow pigments); PG 1, PG 7, PG 10, and PG 36 (green pigments); PO 5, PO 15, PO 16, PO 31, PO 34, PO 36, PO 43, PO 48, PO 51, PO 60, and PO 61 (orange pigments); PR 4, PR 5, PR 7, PR 9, PR 22, PR 23, PR 48, PR 48:2, PR 49, PR 112, PR 122, PR 123, PR149, PR 166, PR 168, PR 170, PR 177, PR 179, PR 190, PR 202, PR 206, PR 207, and PR 224 (red); PV 19, PV 23, PV 37, PV 32, and PV 42 (violet pigments).

Pigments can be made dispersible in a diluent (e.g. organic solvent) by milling the particles with a polymeric binder or by milling and surface treating the particle with suitable polymeric surfactant.

To enhance durability of the imaged substrate, especially in outdoor environments exposed to sunlight, a variety of commercially available stabilizing chemicals can be added optionally to the primer compositions. These stabilizers can be grouped into the following categories: heat stabilizers, UV light stabilizers, and free-radical scavengers.

Heat stabilizers are commonly used to protect the resulting image graphic against the effects of heat and are commercially available from Witco Corp., Greenwich, Conn. under the trade designation "Mark V 1923" and Ferro Corp., Polymer Additives Div., Walton Hills, Ohio under the trade designations "Synpron 1163", "Ferro 1237" and "Ferro 1720". Such heat stabilizers can be present in amounts ranging from about 0.02 to about 0.15 weight percent.

Ultraviolet light stabilizers can be present in the thermal mass transfer composition at amounts ranging from about 0.1 to about 5 weight percent. UV-absorbers are commercially available from BASF Corp., Parsippany, N.J. under the trade designation "Uvinol 400" Cytec Industries, West Patterson, N.J. under the trade designation "Cyasorb UV1164" and Ciba Specialty Chemicals, Tarrytown, N.Y., under the trade designations "Tinuvin 900", "Tinuvin 400" and "Tinuvin 1130".

Free-radical scavengers can be present in an amount from about 0.05 to about 0.25 weight percent of the total thermal mass transfer composition. Nonlimiting examples of free-radical scavengers include hindered amine light stabilizer (HALS) compounds, hydroxylamines, sterically hindered phenols, and the like. HALS compounds are commercially available from Ciba Specialty Chemicals under the trade designations "Tinuvin 123" and "Tinuvin 292" and Cytec Industries under the trade designation "Cyasorb UV3581".

In the preparation of a thermal mass transfer ribbon, a thermal transfer composition is typically dispersed in a non-aqueous solvent and coated onto a carrier. In general, organic solvents tend to dry more readily and thus are preferred for making thermal mass transfer ribbons from such compositions. As used herein, "organic solvent" refers to liquid having a solubility parameter greater than 7 $(cal/cm^3)^{1/2}$. Further, organic solvents typically have a boiling point of less than 250° C. and a vapor pressure of greater than 5 mm of mercury at 200° F. (93° C.).

The solvent may be a single solvent or a blend of solvents. Suitable solvents include alcohols such as mineral spirits, isopropyl alcohol (IPA) or ethanol; ketones such as methyl ethyl ketone (MEK), methyl isobutyl ketone (MIBK), diisobutyl ketone (DIBK); cyclohexanone, or acetone; aromatic hydrocarbons such as toluene and xylene; isophorone; butyrolactone; N-methylpyrrolidone; tetrahydrofuran; esters such as lactates, acetates, including propylene glycol monomethyl ether acetate such as commercially available from 3M under the trade designation "3M Scotchcal Thinner CGS10" ("CGS10"), 2-butoxyethyl acetate such as commercially available from 3M under the trade designation "3M Scotchcal Thinner CGS50" ("CGS50"), diethylene glycol ethyl ether acetate (DE acetate), ethylene glycol butyl ether acetate (EB acetate), dipropylene glycol monomethyl ether acetate (DPMA), iso-alkyl esters such as isohexyl acetate, isoheptyl acetate, isooctyl acetate, isononyl acetate, isodecyl acetate, isododecyl acetate, isotridecyl acetate or other iso-alkyl esters; combinations of these and the like.

The solvent-based coating composition preferably contains at least 5 wt-% solids, at least 10 wt-% solids, or at least 15 wt-% solids of the thermal mass transfer composition. Typically the solvent-based coating composition comprises no more than 50 wt-% solids, more typically less than 40 wt-% solids and more typically less than 30 wt-% solids of the thermal mass transfer composition.

For the preparation of the colored thermal mass transferable composition several techniques may be used to disperse pigments into a polymer matrix to a size of less than 1 micrometer. These techniques include media milling, ball milling, and roll milling. For example, the composition can then be prepared into 25-30 wt-% solids ink composition in solvent through mixing techniques such as paddle mixing. The composition can then be coated onto polyester film by use of a wire wound bar and dried at a thickness of about 1 to 3 microns.

Thermal transfer ribbon articles may be formed by coating the solvent-based composition using any suitable coating method including (e.g. imprint) gravure, roll coating, bar coating, or knife coating, onto a carrier support and drying the mixture at or above room temperature. For gravure coating, the solvent-based coating composition typically has a viscosity ranging from about 20 to about 1000 cps. In the case of knife coating and bar coating, however, the viscosity may range as high as 20,000 cps.

The thermal transfer composition is normally retained on a carrier support prior to thermal transfer. The carrier support can include a sheet, film, ribbon, or other structure. The carrier film is typically from about 1 to about 10 microns thick, and more typically from about 2 to 6 microns thick. An optional anti-stick/release coating can be coated between the carrier film and the thermally transferable composition. Suitable anti-stick/release materials include, but are not limited to, silicone materials including poly(lower alkyl)siloxanes such as polydimethylsiloxane and silicone-urea copolymers, and perfluorinated compounds such as perfluoropolyethers. A back coating can be provided on the opposing surface of the carrier film. In some instances an optional release liner may be provided over the thermally transferable composition to protect it during handling, etc.

Suitable carrier film materials for thermal transfer articles of the invention provide a means for handling the thermal transfer article and are preferably sufficiently heat resistant to remain dimensionally stable (i.e., substantially without shrinking, curling, or stretching) when heated to a sufficiently high temperature to achieve adherence of the adherence layer to the desired substrate. Also, the carrier film preferably provides desired adhesion to the thermally transferable composition during shipping and handling as well as desired release properties from the thermally transferable composition after contact to the substrate and heating. Finally, the carrier and other components of the article preferably exhibit sufficient thermal conductivity such that heat applied in an imagewise fashion will heat a suitable region of the color layer in order to transfer a graphic pattern of desired resolution. Suitable carriers may be smooth or rough, transparent or opaque, and continuous (or sheet-like). The carriers are preferably essentially non-porous. By "non-porous" it is meant that ink, paints and other liquid coloring media or anti-stick compositions will not readily flow through the carrier (e.g., less than 0.05 milliliter per second at 7 torr applied vacuum, preferably less than 0.02 milliliter per second at 7 torr applied vacuum).

Illustrative examples of materials that are suitable for use as a carrier include polyesters, especially polyethylene terepthalate (PET) commercially available from E.I DuPont Demours company under the trade designation "Mylar", polyethylene naphthalate, polysulfones, polystyrenes, polycarbonates, polyimides, polyamides, cellulose esters, such as cellulose acetate and cellulose butyrate, polyvinyl chlorides and derivatives, aluminum foil, coated papers, and the like. The carrier generally has a thickness of 1 to 500 micrometers, preferably 2 to 100 micrometers, more preferably 3 to 10 micrometers. Particularly preferred carriers are white-filled or transparent PET or opaque paper. The carrier film should be able to withstand the temperature encountered during application. For instance, Mylar polyester films are useful for application temperatures under 200° C. with other polyester films being preferred for use at higher temperatures.

In one aspect, a colorless thermal mass transfer ribbon is provided by coating the colorless composition onto a carrier as just described. In another embodiment, a ribbon that concurrently provides a colored layer and a colorless layer can be prepared by providing the colorless composition onto the carrier followed by providing the colored composition above the colorless layer. When such ribbon is employed, the colored layer covered with the colorless layer can be printed onto the substrate during a single printing step.

The ribbon can be employed with various commercially available thermal mass transfer printers. Examples of representative thermal mass transfer printers are those manufactured by Matan Digital Printers Ltd. under the trade designation "Matan Spring12 Thermal Transfer Printer" and by Zebra Technologies Corporation, Vernon Hills, Ill. under the trade designation "Zebra 170xi Printer."

The retroreflective sheeting including the colorless thermal mass transferred composition exhibits a retroreflected brightness as measured according to the test method described in the examples of at least 40 candelas per lux per square meter (abbreviated "cpl") for white sheeting. The colorless thermal mass transferred composition described herein can provide improved retroreflected brightness and/or gloss in comparison to commercially available colorless thermal transfer ribbon. The improvement in brightness can be at least 5 to 30 cpl. In some embodiments, the brightness is improved by 50 to about 150 cpl or greater. The colorless thermal mass transferred composition can improve the downweb and crossweb 60 degree gloss by at least 5 to 10 as well. Further, the color of the colored thermal mass transferred composition is not affected and thus is substantially the same with the inclusion of the colorless thermal mass transferred composition.

Examples 1-6

A roll of retroreflective sheeting 6 inches wide by about 50 yards long commercially available from 3M under the trade designation 3M™ High Intensity Prismatic Reflective Sheeting 3930 ("3930 High Intensity Prismatic") was thermal mass transfer printed with a green thermal mass transfer ribbon commercially available from 3M under the trade designation 3M Traffic Green Ribbon ("TTR2308"). The 3930 High Intensity Prismatic sheeting was printed in a pattern of 5.5 inch×3.25 inch solid blocks separated by a 0.75 inch unprinted gap between the green printed blocks.

Six colorless compositions were prepared according to the following base formulation:

15.5% acrylic resin
6.7% UCAR VAGH vinyl resin
1.3% Tinuvin 400
0.7% Tinuvin 123
75.8% solvent mix (1:1.75 Toluene:MEK)
using the specific acrylic resin identified in Table 3.

TABLE 3

| Sample | Ex. 1 | Ex. 2 | Ex. 3 | Ex. 4 | Ex. 5 | Ex. 6 |
|---|---|---|---|---|---|---|
| Acrylic resin | Dianal BR-80 | Paraloid A-11 | Paraloid A-14 | Paraloid A-21 | Elvacite 2010 | Elvacite 2021 |

Each of the formulations in Table 3 was coated onto a 4.7 micron thick, 4.25 inch wide and approximately 24 inches long strip of PET using a #6 Meyer rod (12.5 microns wet). The coated PET was air dried to give approximately 3 microns dry thickness on the PET. The coated PET was then spliced into existing rolls of commercially-available, 4.25"-wide thermal mass transfer ribbon (TMT). Also spliced into the ribbon roll was a section of a commercially-available colorless TMT ribbon subsequently described as the "Comparative". Based on quantitative analysis by NMR the thermoplastic composition of the commercially-available colorless TMT ribbon contains 72% PMMA and 28% BHT. The GPC shows 64% of the PMMA has a $M_w$ of 100,000 g/mole based on polystyrene standards, 33% BHT and 2.8% of a minor component with a nominal molecular weight of 880 g/mole.

The spliced roll was put in a Zebra 170xi printer and the printer brightness setting ("Br") on the printer was set as provided in Tables 4 and 5. The colorless samples were printed both on unimaged 3930 High Intensity Prismatic sheeting and on top of the blocks of green imaged 3930 High Intensity Prismatic sheeting. The colorless samples were printed in a pattern of 3.5 inch square blocks with a 0.25 inch gap between the colorless printed blocks.

The gloss, brightness, and color were measured according to the following test methods:

Gloss

The gloss was measured at a 60° geometry with an instrument available from BYK Gardner under the trade designation "Micro-TRI-Gloss". "0" means that the long axis of the glossmeter was running in the downweb sheeting direction, while "90" means that the long axis of the glossmeter was running perpendicular to the downweb sheeting direction during measurements.

Initial Brightness and Brightness Retention

The brightness was measured with a retroluminometer as described in U.S. Defensive Publication T987,003 at an observation angle of 0.2° and an entrance angle of −4.0°. 0 and 90 refer to the orientation of the sheeting when making measurements. 0 means that the web direction of the 3930 High Intensity Prismatic sheeting was pointing at the back wall during measurements and 90 means that the web direction of the 3930 High Intensity Prismatic sheeting was running parallel to the back wall during measurements.

Color

The color was measured with a HunterLab ColorFlex CX950 available from Hunter Associates Laboratory, Inc., Reston, Va. with a 0/45 geometry, D65/2° observation angle using a Yxy colorscale and a port size of 1.25 inches.

Table 4 provides data measurements taken of the colorless printed blocks over the green blocks on 3930 High Intensity Prismatic sheeting. Table 4 also includes data measurements for the "Control", where "Control" refers to an adjacent portion of sheeting that was thermal mass transfer printed only with the green and therefore lacked the colorless thermal mass transfer printed layer. Retroreflective brightness and gloss were measured at 0 and 90 sheeting orientations, the 0 and 90 measurements were averaged and the percent of sample brightness retained and gloss were calculated. The percent of sample brightness and gloss retained were calculated by taking the cpL value of the Comparative or the Example divided by the cpL or gloss value of the Control and then multiplying by 100. The Yxy colorscale values are also provided. Table 5 provides the retroreflective brightness measurements taken of the colorless printed blocks over the 3930 High Intensity Prismatic sheeting in the areas not printed with green. The target is to have a colorless to control percent of 100, which means that the brightness of a colored image is not diminished by the presence of the colorless layer printed over the top of the colored layer.

TABLE 4

| | | cpL | | | | gloss | | | | Color | | |
|---|---|---|---|---|---|---|---|---|---|---|---|---|
| | Br | 0 | 90 | average | % | 0 | 90 | average | % | Y | x | y |
| Comparative | 28 | 47.2 | 45.3 | 46.3 | 60 | 72.1 | 69 | 70.6 | 90.1 | 7.52 | 0.1328 | 0.419 |
| Control | 25 | 72.1 | 80.9 | 76.5 | | 79.1 | 77.5 | 78.3 | | 7.45 | 0.1321 | 0.4174 |
| Ex. 1 | 26 | 65.6 | 58.7 | 62.2 | 88 | 80.6 | 80.8 | 80.7 | 100.9 | 7.72 | 0.1338 | 0.4203 |
| Control | 25 | 71 | 69.9 | 70.5 | | 82 | 78 | 80.0 | | 7.63 | 0.1336 | 0.4177 |
| Ex. 2 | 20 | 52.4 | 60.8 | 56.6 | 86 | 77 | 75.4 | 76.2 | 96.0 | 7.73 | 0.1349 | 0.4189 |

TABLE 4-continued

| | | cpL | | | | gloss | | | | Color | | |
|---|---|---|---|---|---|---|---|---|---|---|---|---|
| | Br | 0 | 90 | average | % | 0 | 90 | average | % | Y | x | y |
| Control | 25 | 62.2 | 69.1 | 65.7 | | 81 | 77.7 | 79.4 | | 7.57 | 0.1322 | 0.4173 |
| Ex. 3 | 28 | 63 | 71.3 | 67.2 | 97 | 80.6 | 79.8 | 80.2 | 102.0 | 7.66 | 0.1313 | 0.4213 |
| Control | 25 | 77.4 | 61.2 | 69.3 | | 80.3 | 77 | 78.7 | | 7.49 | 0.1311 | 0.4201 |
| Ex. 4 | 28 | 52.8 | 55.6 | 54.2 | 79 | 73.6 | 75.9 | 74.8 | 93.2 | 7.61 | 0.1319 | 0.42 |
| Control | 25 | 70.2 | 67.4 | 68.8 | | 80.1 | 80.3 | 80.2 | | 7.54 | 0.1318 | 0.4176 |
| Ex. 5 | 26 | 57.6 | 62.7 | 60.2 | 85 | 79.1 | 75.6 | 77.4 | 96.5 | 7.59 | 0.1323 | 0.4202 |
| Control | 25 | 60.6 | 80.8 | 70.7 | | 80.3 | 80 | 80.2 | | 7.58 | 0.1318 | 0.42 |
| Ex. 6 | 24 | 58.6 | 67.3 | 63.0 | 94 | 79 | 78.6 | 78.8 | 101.9 | 7.56 | 0.133 | 0.4186 |
| Control | 25 | 64 | 70.5 | 67.3 | | 79 | 75.7 | 77.4 | | 7.57 | 0.1321 | 0.4163 |

The data in Table 4 show that sheeting imaged with the colorless thermal mass transferred composition exhibited improved retroreflected brightness and gloss in comparison to the Comparative. The data also show that the presence of the colorless thermal mass transferred composition did not substantially affect the color properties of the colored imaged area.

TABLE 5

| | | cpl | | | |
|---|---|---|---|---|---|
| | Br | 0 | 90 | average | % |
| Comparative | 28 | 370 | 305 | 337.5 | 50 |
| Control | 25 | 656 | 681 | 668.5 | |
| Ex. 1 | 26 | 453 | 515 | 484.0 | 78 |
| Control | 25 | 535 | 705 | 620.0 | |
| Ex. 2 | 20 | 336 | 332 | 334.0 | 61 |
| Control | 25 | 537 | 567 | 552.0 | |
| Ex. 3 | 28 | 292 | 340 | 316.0 | 51 |
| Control | 25 | 533 | 700 | 616.5 | |
| Ex. 4 | 28 | 430 | 470 | 450.0 | 81 |
| Control | 25 | 583 | 527 | 555.0 | |
| Ex. 5 | 26 | 340 | 433 | 386.5 | 62 |
| Control | 25 | 690 | 555 | 622.5 | |
| Ex. 6 | 24 | 454 | 428 | 441.0 | 71 |
| Control | 25 | 570 | 665 | 617.5 | |

The data in Table 5 show that sheeting imaged with the colorless thermal mass transferred composition of Examples 1, 4 and 6 exhibited improved retroreflected brightness in comparison to the Comparative. Examples 2, 3 and 5 are less preferred colorless thermal mass transferred compositions for 3930 High Intensity Prismatic retroreflective sheeting.

What is claimed is:

1. Retroreflective sheeting comprising:

a retroreflective substrate including a viewing surface and a non-viewing surface;

a colored thermal mass transferred composition disposed on the viewing surface; and a colorless thermal mass transferred composition disposed on the colored thermal mass transferred composition;

wherein the colorless thermal mass transferred composition comprises a homogeneous unreactive thermoplastic composition comprising at least one acrylic resin and less than 3 wt-% of components that are opaque at ambient temperature.

2. The retroreflective sheeting of claim 1 wherein the thermoplastic composition comprises less than 3 wt-% of material selected from inorganic fillers, waxes, crystalline polymers, and combinations thereof.

3. The retroreflective sheeting of claim 1 wherein the thermal mass transferred composition has a percent of maximum diffuse luminous transmittance to total luminous transmittance of less than 50%.

4. The retroreflective sheeting of claim 1 wherein the thermoplastic composition is free of wax.

5. The retroreflective sheeting of claim 1 wherein the colorless thermal mass transferred composition is provided on an exposed surface of the retroreflective sheeting.

6. The retroreflective sheeting of claim 1 wherein a colored thermal transferred composition is provided between the retroreflective sheeting and the colorless thermal mass transferred composition.

7. The retroreflective sheeting of claim 1 wherein the thermoplastic composition comprises one or more acrylic resins in an amount of at least 50 wt-%.

8. The retroreflective sheeting of claim 7 wherein at least one of the acrylic resins has a weight average molecular weight of at least 80,000 g/mole.

9. The retroreflective sheeting of claim 7 wherein the thermoplastic composition comprises up to about 50 wt-% of a modifying polymer.

10. The retroreflective sheeting of claim 9 wherein the modifying polymer is selected from an acrylic resin, a polyvinyl resin, a polyester, a polyurethane, and mixtures thereof.

11. The retroreflective sheeting of claim 10 wherein the modifying polymer is a polyvinyl resin.

12. The retroreflective sheeting of claim 1 wherein the colorless thermal mass transferred composition has a thickness ranging from about 1 to 10 microns.

13. An article comprising:

a polymeric retroreflective film comprising at least one viewing surface;

a colored thermal mass transferred composition disposed on the at least one viewing surface; and a colorless thermal mass transferred composition disposed on the colored thermal mass transferred composition wherein the colorless thermal mass transferred composition comprises a homogeneous unreactive thermoplastic composition comprising at least one acrylic resin and less than 3 wt-% of components that are opaque at ambient temperature.

14. A thermal mass transfer ribbon article comprising:

a carrier including at least one viewing surface;

a colored thermal mass transferred composition disposed on the at least one viewing surface; and a colorless homogeneous unreactive thermoplastic composition comprising at least one acrylic resin and less than 3 wt-% of components that are opaque at ambient temperature, the colorless homogeneous unreactive thermoplastic composition disposed on the colored thermal mass transferred composition.

15. The thermal mass transferable ribbon article of claim 14 further comprising a colored thermal mass transferable composition disposed between the colorless composition and the carrier.

* * * * *